US005158489A

United States Patent [19]

Araki et al.

[11] Patent Number: 5,158,489

[45] Date of Patent: Oct. 27, 1992

[54] MARINE RESCUE LIFE NET

[75] Inventors: Kazuharu Araki; Nobuyuki Yamamoto, both of Fukuoka, Japan

[73] Assignee: Nippon Suisan Kaisha, Ltd., Tokyo, Japan

[21] Appl. No.: 675,194

[22] Filed: Mar. 26, 1991

[30] Foreign Application Priority Data

Mar. 30, 1990 [JP] Japan ..... 2-86887

[51] Int. Cl.[5] ..... B63C 9/00

[52] U.S. Cl. ..... 441/80

[58] Field of Search ..... 441/80, 81, 84; 43/7, 43/10, 14

[56] References Cited

U.S. PATENT DOCUMENTS 2,557,079 6/1951 Cutri ..... 441/80

4,652,246 3/1987 Thorgeirsson ..... 441/80

FOREIGN PATENT DOCUMENTS 207758 12/1923 United Kingdom ..... 441/80

*Primary Examiner*—Jesus D. Sotelo

*Attorney, Agent, or Firm*—Sughrue, Mion, Zinn, Macpeak & Seas

[57] ABSTRACT

A marine life net used for rescuing the victim of a marine accident. The marine rescue life net includes a network structure composed of vertical ropes and transverse ropes knitted across each other, a plurality of marginal buoys attached to opposite marginal ends of the network structure, upper and lower elongate members, a suspending structure serving to suspend the network structure, and a plurality of central vertical buoys, each attached to a vertical central line of the network structure.

10 Claims, 2 Drawing Sheets

MARINE RESCUE LIFE NET

TECHNICAL FIELD

The present invention relates to a marine rescue life net to be used in effecting the rescue of a victim of a marine accident. In particular, the present invention may be used in the event that a crew member or other person falls from a vessel, ship, boat or the like into the sea, as, for example, during the course of work. The inventive marine rescue life net includes a network structure composed of vertical ropes and transverse ropes knitted across each other, a plurality of marginal buoys attached to opposite marginal edges of the network structure, upper and lower elongate members, suspending means serving to suspend the network structure, and a plurality of central vertical buoys attached along a central vertical rope of the network structure.

BACKGROUND OF THE INVENTION

Marine accidents, as, for example, when a crew member or other person falls from a boat, ship, vessel, or the like (hereinafter collectively referred to as a "vessel"), frequently happen during the course of work, particularly during fishing from a vessel, and often as the result of a frivolous mistake or carelessness. Persons involved in such an accident (hereinafter referred to as a "victims"), in the event that the vessel is a small vessel which may be maneuvered easily, are easily rescued. However, in the event of an accident involving a larger, less maneuverable vessel, considerable time may elapse before the vessel can reach the site of the accident, and it is often too late to effect a rescue.

The number of small recreational vessels is increasing, and accidents in which victims fall from such vessels typically occur in shallow water areas or around reefs. When an accident occurs in a shallow water area, the accident site cannot be accessed by a large vessel. Furthermore, if the marine accident occurs in polar seas where conditions can be very rough, the rescue of a victim is nearly impossible.

Under certain safety regulations, vessels are generally required to maintain life buoys, life vests, life rafts, life boats and other life-saving tools and facilities, depending on the size of the vessel and the number of persons carried. Of these life-saving tools and facilities, life vests are commonly worn by passengers and crew when an emergency situation occurs, whereas life buoys and life rafts are typically thrown toward persons who have fallen overboard. However, only when there are comparatively good conditions for rescue can a victim be rescued using such life-saving tools. Furthermore, even under the best of conditions, considerable time will elapse before the life-saving tools thrown from a large boat can reach the victim, and it is often too late to effect a rescue. Also, it should be noted that fishing is usually done in cold water areas under rough marine conditions. When a falling accident occurs under such conditions, even if the vessel can reach the site in a short period of time, the range for which such life-saving tools may be thrown is limited as compared to water areas with comparatively good conditions. Thus, the use of standard life-saving tools is a difficult proposition even in the best of conditions.

In water areas with rough marine conditions, the victim will generally fatigue rapidly. Therefore, the victim may not have the strength left to grasp a life buoy or life raft. In particular, if a life buoy or raft is thrown to a place distant from the victim, it is often impossible for the victim to reach it by swimming. Moreover, in the polar seas or other cold water areas, there are often strong winds and waves. Therefore, a thrown life buoy or life raft will tend to be carried leewardly by the wind, while the victim may be carried along by a strong ocean or tidal current in a different direction. It may also take a long time for a vessel to reach the rescue site. Even if the site is accessible, it is typically difficult and dangerous to conduct a rescue operation by throwing a life buoy or the like.

SUMMARY OF THE INVENTION

Accordingly, the inventors have developed a marine life net comprising vertical and transverse ropes braided or knitted into the form of a network structure to replace the conventional life-saving tools such as life buoys and life garments. The life net comprises a network structure formed by knitting natural or synthetic resin ropes with buoys attached to portions of the rope constituting marginal edges of the network structure. The life net may be suspended by an upper end via a hanging rope to a boom rotatably mounted on the mast of a vessel. Since the life net has a network structure, it can be thrown relatively far compared to conventional life buoys or life rafts. Moreover, since buoys are attached to the opposite marginal edges of the network structure, the opposite edges of the network structure will float when thrown into the water. Thus, even if the victim is considerably fatigued, it is easier for the victim to catch the life net, or to be caught by the life net. The life net can then be pulled up onto the vessel by winding the hanging rope, which may also be grasped by the victim. At the same time, the victim can be safely and reliably pulled up onto the vessel without having to tightly grasp the network structure since it suffices to merely entangle the victim with the network structure.

Briefly, the life net of the present invention comprises a network structure comprising vertical and transverse ropes braided in the form of a net. The invention provides an extended life-saving range by making use of the advantages of the network structure to attain safe and reliable rescue.

The life-saving part of the life net comprises a network structure which will entangle the victim or, alternatively, can be taken hold of by the victim. The network structure itself has no buoyancy. Accordingly, buoys are provided on the ropes constituting the marginal edges of the network structure, thus providing a certain buoyancy to the network structure. This facilitates the entangling in or taking hold of the life net by the victim. Thus, even a considerably fatigued person can easily grasp or become entangled in the life net. Since the network structure is comprised of vertical and transverse ropes and hence is highly flexible and light in weight, the life net can be thrown comparatively far. This means that the victim may be rescued even if the vessel cannot closely approach the rescue site. Furthermore, the life net can be readily and compactly folded and accommodated on the vessel without requiring substantial space.

In the first stage of constructing the life net of the present invention, buoys are firmly attached to a portion of vertical ropes constituting opposite marginal edges of the network structure, i.e., a portion of vertical ropes extending from the upper end to a substantially central portion thereof. With only this construction, however, a portion of the life net having no buoys attached thereto would tend to sink. The upper portion of the network structure that would float could not be caught very easily by a person of limited strength and endurance. Also, if a victim entangled his or her body with the lower net portion, he or she might be swept away by waves. Thus, the life net would be incapable of rescuing a person involved in an accident.

In the next stage, vertical ropes constituting opposite marginal edges of the network structure are provided with a single-piece, bar-like buoy. However, the buoyancy of the bar-like buoy in this construction interferes with the spreading of the life net after it has been thrown into the water. Moreover, when the life net is to be removed from storage for use in an emergency rescue, it cannot be unfolded quickly.

Previous attempts to improve the life net by attaching buoys to vertical ropes constituting opposite marginal edges of the network and over the entire rope length have proven to be insufficient. For example, if a single piece bar-like buoy is attached to each marginal edge of the network structure, it is difficult to grasp the marginal edge of the network structure and, consequently, only those who manage to reach the lower end of the network structure can be rescued. Moreover, single piece bar-like buoys interfere with the unwinding and spreading of the network.

The life net according to the present invention comprises a network structure comprising vertical and transverse ropes knitted across each other and a plurality of buoys attached to marginal edges of the network structure. The invention permits rescue even in rough sea conditions which would not permit a rescue vessel to access the victim. According to the present invention, a plurality of marginal buoys are provided on each vertical rope constituting a marginal edge of the network structure and over the entire rope length. In addition, each marginal buoy is attached to a portion on the vertical edge rope corresponding to a single hole or mesh of the network structure. Consequently, the buoys do not hinder the rescue operation and the life net is easily accommodated during storage. Furthermore, the life net can be readily spread when thrown towards a victim.

In the present invention, a plurality of buoys are attached to vertical ropes constituting opposite marginal edge of the network structure and over an entire rope length, such that a buoy is provided within each hole or mesh of the network. Consequently, the life net can be easily folded in a compact manner and stored, and can be readily spread in the event of an emergency. Upper and lower bar-like elongate members are provided at the upper and lower ends of the network structure, a structure which is adapted to be suspended vertically from the upper end. The upper and lower elongate members are formed from hollow cylindrical members and, consequently, impart a predetermined buoyancy to the network structure. Furthermore, central buoys are provided along at least one portion of the central vertical rope of the network. Consequently, the central portion of the network structure has additional buoyancy as compared to the portion without central buoys which tends to sink slightly. Therefore, even an extremely fatigued person can access the network structure over the slightly submerged portion by using his/her foot and/or leg and thereafter pulling his/her body on top.

The present invention incorporates many of the features and advantages of conventional life nets having network structures. Furthermore, the present life net can be grasped more easily than can conventional life buoys or rings, life garments or life rafts. Furthermore, unlike life rafts, the present invention is not carried along by wind, waves, or current. Finally, the present invention provides significant improvements over earlier developed life nets.

DETAILED DESCRIPTION OF THE REFERRED EMBODIMENTS

Figure 1:
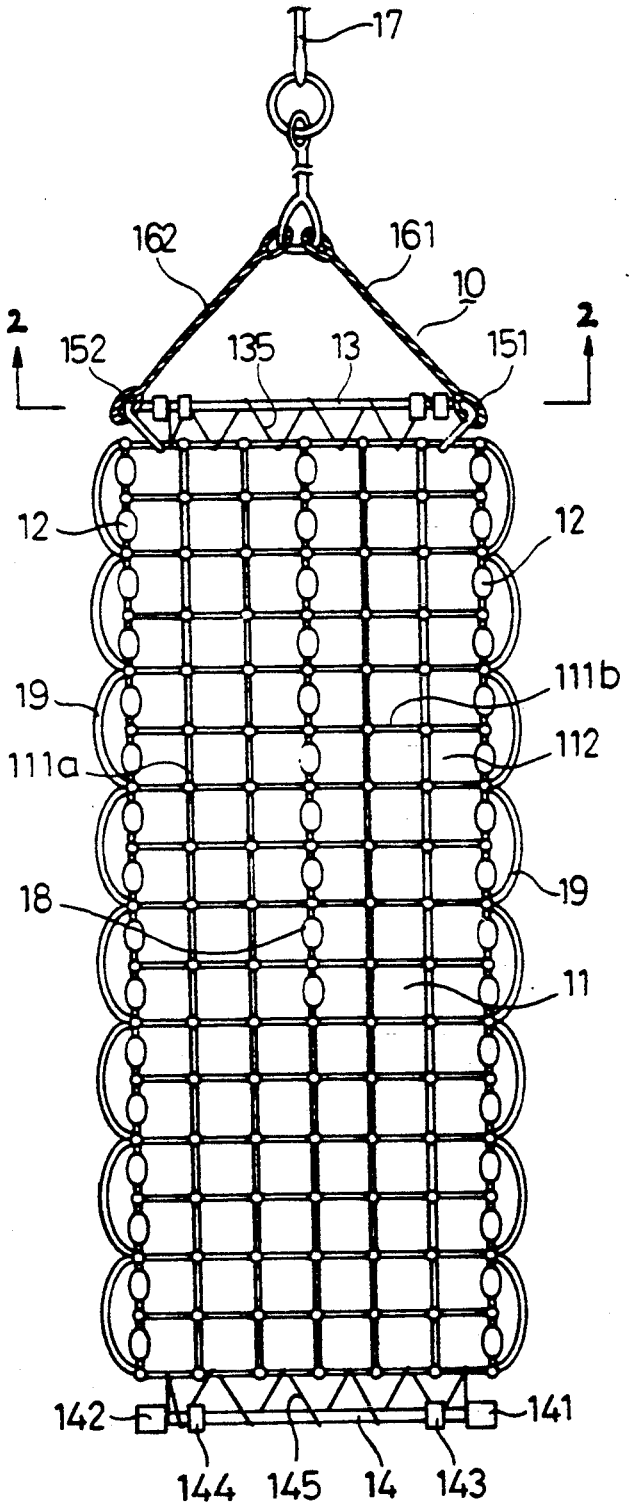
FIG. 1 is a plan view showing a preferred embodiment of the life net according to the present invention.

Referring to FIG. 1, reference numeral 10 designates a preferred embodiment of the marine life net according to the present invention. The life net 10 includes a network structure 11, a plurality of marginal buoys 12, and upper and lower elongate members 13 and 14. The network structure 11 is composed of vertical ropes 111*a* and transverse ropes 111*b* made from natural or synthetic resin, and braided into the form of a net. Network structure 11 has quadrilateral or rectangular meshes 112. This shape of the mesh, however, is by no means limited to the above shape, so long as the body of the person to be rescued cannot pass through the mesh 112. A plurality of marginal buoys 12 are attached to vertical ropes 111*a* constituting opposite marginal edges of the network structure 11 and over the entire rope length. Marginal buoys 12 are attached individually between each mesh 112, so that the network structure 11 can be readily bundled and stored.

The marginal buoys may be attached in various ways. For example, each buoy 12 can be formed with a through hole, through which ropes 111*a* are passed.

With buoys 12 attached to each vertical rope 111*a* and 111*b* and for each individual mesh 112, the network structure 11 can be readily bundled and stored as noted above and, furthermore, the life net can be spread quickly during a rescue. More particularly, since buoys 12 are provided on vertical ropes constituting opposite marginal edges of the network structure 11 and over the entire rope length, opposite marginal edges of the network structure 11 float over the entire length of the network. Thus, a victim can readily grasp the floating marginal edges of the network structure.

Upper and lower elongate members 13 and 14 are attached to respective upper and lower ends of the network structure 11. These elongate members 13 and 14 have substantially the same length as the length of upper and lower ends of the network structure 11, and are preferably hollow cylindrical members made from a synthetic resin. They may be attached to upper and lower ends of the network structure 11 in various ways. However, by constructing the elongate member as a bar-like member shown in FIG. 2, they can be mounted readily and reliably.

Figure 2:
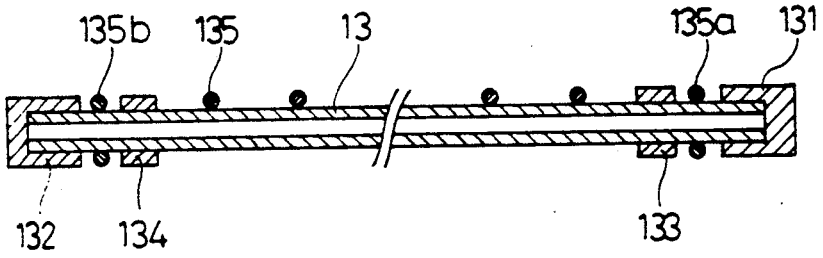
FIG. 2 is a sectional view taken along arrow line 1—1 in FIG. 1.

FIG. 2 is a sectional view taken along a line A—A in FIG. 1. The upper and lower members 13 and 14 (the upper member 13 being shown as an example in FIG. 2) are hollow cylindrical members made from a synthetic resin. Flange members 131 and 132 are fitted on respective ends of the upper member 13 to close both ends.

Annular members 133 and 134 are fitted around the upper member 13 at a predetermined spacing from the respective flange members 131 and 132. The upper end of the network structure 11 and the upper member 13 are connected by a coupling member 135, such as a string or the like. Opposite ends 135*a* and 135*b* of the coupling member 135 ar secured to the upper member 131 and 132 and corresponding annular members 133 and 134. The lower member 14 is constructed similarly to the upper member 13 and has its opposite ends closed by flange members 141 and 142. The lower member 14 is coupled to the lower end of network structure 11 by a string or similar coupling member 145 whose opposite ends are secured to the lower member 14 at positions between the flange members 141 and 142 and corresponding annular members 143 and 144. Accordingly, the upper and lower members 13 and 14 can be readily removed from the upper and lower ends of the network structure 11 by removing the opposite end flange members 131, 132, 141 and 142 and by removing the coupling members 135 and 145.

A suspending structure is secured to the upper member 13. The upper member 13 is coupled to the upper end of network structure 11. During a rescue operation, the network structure 11 is suspended by the suspending structure. The suspending structure can be constructed in various ways, an example of which is shown in FIG. 1. In FIG. 1, the suspending structure includes ring members 151 and 152 which are tied to suspending ropes 161 and 162. The suspending ropes 161 and 162 have upper ends which are coupled to a winch rope 17. The rings 151 and 152 are coupled to coupling portions at opposite ends of the upper member 13. Accordingly, a victim can be pulled aboard a vessel by merely winding up the winch rope 17.

In the life net of the present invention, at least one portion of the center vertical rope is provided with a plurality of central buoys 18, each within a mesh of the network structure 11. Central buoys 18 may be provided over the entire rope length. In one preferred embodiment, central buoys 18 are provided along a center line of the network structure 11 over a portion of the network ranging between the upper end and the center of the network structure. In certain circumstances, it is preferable to provide buoys 18 only on a portion of the central, vertical rope extending from the upper end thereof to a central portion, or to a position slightly exceeding the central portion, rather than over the entire rope length.

Network structure 11 is made buoyant by marginal buoys 12 attached to each of the vertical ropes 111*a* constituting opposite marginal edges of the network structure 11. If central buoys 18 are provided on a portion of the vertical rope 111*a* constituting a central line of the network structure 11, the central portion can be made to sink slightly to provide a concave profile, that is, a downwardly curved cross section. The victim, therefore, can position his or her body within this recessed portion of the network structure 11. However, a portion of the network structure extending from the upper end to a central portion should remain on the surface of the water so that the victim's head will remain above water.

In addition to the provision of central buoys 18 on the network structure 11, hand ropes 19, which can be grasped by the victim, are provided on each of the vertical ropes 111*a* constituting the opposite marginal edges of the network structure 11.

With the provision of a plurality of marginal buoys 12 along opposite edges of the network structure 11 and over the entire length thereof, a portion of the network structure 11 extending from a vertically central portion to the lower end has a downwardly concave profile in the sea. This downwardly concave profile facilitates rescue. Nonetheless, marginal buoys 12 provided on the opposite marginal edges of the network structure may interfere with the grasping of the edge of network structure 11 by a victim. For this reason, hand ropes 19 are provided which surround each marginal buoy 12.

A specific example of a life net having the above construction is described as follows:

Vertical and transverse ropes 111*a* and 111*b* constituting a network structure 11 are made of natural or synthetic resin fibers, specifically, materials which are less inclined to deteriorate as a result of weathering and which exhibit a specific gravity substantially equal to or slightly greater than that of sea water. Furthermore, the tensile strength of the ropes 111*a* and 111*b* is typically 1,000 kg/cm$^2$ or above. In particular, their tensile strength should be such that they cannot be broken, even if two persons are caught in the same mesh. As an example, two men weighing 70 kg and whose clothes each contain 20 kg of sea water results in a total weight of 180 kg. Estimating the tensile strength reduction of ropes 111*a* and 111*b* in the sea to be 15% and taking a safety factor into consideration, the load applied to the mesh would be approximately 300 kg or more. Therefore, the above tensile strength of 1,000 kg/cm$^2$ or above would prove to be more than adequate.

Furthermore, since victims often entangle their hands and legs with ropes 111*a* and 111*b* of the network structure 11, the ropes 111*a* and 111*b* must not be unduly thin or they may chafe or even cut the skin of a victim. For this reason, the ropes 111*a* and 111*b* preferably have a diameter of 6 mm or more.

Marginal and central buoys 12 and 18 are shaped conventionally and are preferably made from a foamed synthetic resin. Also, each preferably has dimensions of approximately 172 $\times$113$\times$26 cm and a buoyancy of 1.2 kg or more. The total buoyancy required to support the body of a person to be rescued is at least about 10 kg. Thus, for four victims, the required buoyancy amounts to at least 40 kg. Thus, a total of 40 buoys with 40$\times$1.2 kg or 48 kg of buoyancy would be sufficient to rescue four victims.

The surface of marginal and central buoys 12 and 18 is preferably provided with a reflective and/or fluorescent coating such that the buoys are more easily identified by a victim. This is especially important during a night rescue. Such protective coatings also enhance the buoy's resistance against sea water and the effects of weather.

The holes or meshes of the network structure 11 may have any desired shape. However, a quadrilateral shape is sufficient. In any event, a mesh size of 250 mm is sufficient to prevent a victim from passing through the mesh of the network structure.

The upper and lower elongate members 13 and 14 are cylindrical and made from a synthetic resin, e.g., vinyl chloride. Their buoyancy should be greater than that of the network structure 11. This has the effect of enhancing the properties of the network structure 11 when it is to be spread and thrown into the sea. Flange members 131, 132, 141 and 142 should be fitted on opposite ends of members 13 and 14 as shown in FIG. 2 to seal the members 13 and 14 thus providing additional buoyancy.

Furthermore, the upper member 13 should have a buoyancy greater than that of the lower member 14.

Hand ropes 19 are provided on the opposite marginal edges of the network structure 11 such that each rope surrounds at least one marginal buoy 12. They should preferably have a diameter substantially equal to that of the ropes 111*a* and 111*b*.

As described above, the life net of the present invention has a plurality of marginal buoys provided on the opposite marginal edges of a network structure formed by ropes knitted or braided to form a network. The buoys are provided over the entire length of the vertical ropes and, individually, for each mesh of the network structure. The network structure is capable of being suspended at its upper end. A plurality of central buoys are further provided on at least a portion of a substantially central vertical rope of the network structure.

Thus, when the life net of the invention is thrown into the sea, even an extremely fatigued victim can be readily rescued. Furthermore, the inventive life net can be used in shallow water areas where a large vessel may have difficulty accessing the victim.

We claim:

1. A marine rescue life net comprising:

a network comprising vertical and transverse ropes arranged orthogonally to form a plurality of similarly sized interstices;

a plurality of marginal buoys attached to ones of said vertical ropes constituting opposite marginal edges of said network, said marginal buoys being disposed singularly between adjacent transverse ropes;

upper and lower elongate members engaged with upper and lower ends, respectively, of said network;

suspending means coupled to said upper elongate member; and a plurality of central buoys attached to at least a portion of at least one central vertical rope of said network.

2. The marine rescue life net according to claim 1, wherein said interstices are sufficiently small to prevent a victim from passing through said interstices.

3. The marine rescue life net according to claim 1, where said interstices are quadrilateral in shape.

4. The marine rescue life net according to claim 1, wherein said upper and lower elongate members comprise hollow, cylindrical members made from a synthetic resin.

5. The marine rescue life net according to claim 1, wherein said plurality of central buoys are arranged to extend over at least an upper one-third of the network.

6. The marine rescue life net according to claim 1, further comprising at least one hand rope, said hand rope being attached to at least a portion of said vertical ropes constituting marginal edges of said network.

7. The marine rescue life net according to claim 1, wherein said marginal and central buoys are made from a foamed synthetic resin.

8. The marine rescue life net according to claim 1, wherein said marginal and central buoys are coated with a reflective paint.

9. The marine rescue life net according to claim 1, wherein said upper elongate member has a buoyancy greater than a buoyancy of said lower elongate member.

10. The marine rescue life net according to claim 1, wherein said marginal and central buoys are coated with a fluorescent paint.

* * * * *